US008944826B1

(12) United States Patent
Wilkolaski et al.

(10) Patent No.: US 8,944,826 B1
(45) Date of Patent: Feb. 3, 2015

(54) MAGNETIC CONNECTION FOR CABLE ASSEMBLY OF ELECTRONIC DEVICE

(71) Applicant: Curbell Medical Products, Inc., Orchard Park, NY (US)

(72) Inventors: Edward A. Wilkolaski, Lancaster, NY (US); Christopher P. Camacho, Derby, NY (US)

(73) Assignee: Curbell Medical Products, Inc., Orchard Park, NY (US)

( * ) Notice: Subject to any disclaimer, the term of this patent is extended or adjusted under 35 U.S.C. 154(b) by 65 days.

(21) Appl. No.: 13/943,290

(22) Filed: Jul. 16, 2013

(51) Int. Cl.
*H01R 13/62* (2006.01)

(52) U.S. Cl.
CPC ..... *H01R 13/6205* (2013.01)
USPC ..... 439/39

(58) Field of Classification Search
USPC ..... 439/39, 38; 600/391; 70/57; 292/251.5
See application file for complete search history.

(56) References Cited

U.S. PATENT DOCUMENTS

| | | | | |
|---|---|---|---|---|
| 2,170,287 | A | | 6/1937 | Kinnebrew |
| 3,521,216 | A | | 7/1970 | Tolegian |
| 3,779,052 | A | | 12/1973 | Deitch |
| 3,810,258 | A | | 5/1974 | Mathauser |
| 3,855,827 | A | * | 12/1974 | Hallman et al. ..... 70/134 |
| 4,339,853 | A | | 7/1982 | Lipschitz |
| 4,380,162 | A | | 4/1983 | Woolfson |
| 4,398,230 | A | | 8/1983 | Joannais |
| 4,425,771 | A | | 1/1984 | Beach et al. |
| 4,627,251 | A | | 12/1986 | Bhate |
| 4,653,503 | A | * | 3/1987 | Heath ..... 600/391 |
| 4,767,337 | A | * | 8/1988 | Kawasaki et al. ..... 439/34 |
| 4,947,846 | A | * | 8/1990 | Kitagawa et al. ..... 600/391 |
| 4,987,754 | A | | 1/1991 | Minasy |
| 5,077,872 | A | | 1/1992 | Guthammar |
| 5,382,167 | A | | 1/1995 | Janson, Jr. |
| 5,476,386 | A | * | 12/1995 | Booth ..... 439/40 |
| 5,507,662 | A | | 4/1996 | Nyman |
| 5,641,299 | A | | 6/1997 | Meguro et al. |

(Continued)

FOREIGN PATENT DOCUMENTS

| | | | |
|---|---|---|---|
| DE | 10333403 | A1 | 9/2004 |
| EP | 338105 | A1 | 10/1989 |

(Continued)

OTHER PUBLICATIONS

D. Murph, Belkin BreakFree Adds Magnetic Breakaway Connector to Your Guitar Cable, Engadget, Jul. 22, 2008.

*Primary Examiner* — Alexander Gilman
(74) *Attorney, Agent, or Firm* — Hodgson Russ LLP

(57) ABSTRACT

A cable connection apparatus for an electronic device receives and retains a cable connector at the end of a cable carrying power and/or data signals. The apparatus comprises a housing defining a receptacle sized to receive the cable connector, a compartment, and a passage communicating between the compartment and the receptacle. A magnetic retaining element is coupled to a spring member located in the compartment and extends through the passage and into an external recess of the cable connector to retain the cable connector in the receptacle. The retaining element is removable from within the cable connector recess against the spring member bias by a magnetic force applied from a location external to the housing. A tool having a magnet may be used to apply magnetic force to remove the retaining element from the recess to permit withdrawal of the cable connector from the receptacle.

20 Claims, 7 Drawing Sheets

(56) References Cited

U.S. PATENT DOCUMENTS

| | | | | |
|---|---|---|---|---|
| 5,666,829 | A * | 9/1997 | Aikens | 70/57 |
| 5,788,402 | A | 8/1998 | Banda et al. | |
| 6,030,229 | A | 2/2000 | Tsutsui | |
| 6,084,498 | A | 7/2000 | Stelter et al. | |
| 6,182,336 | B1 | 2/2001 | Bauer | |
| 6,267,602 | B1 | 7/2001 | Mendelson et al. | |
| 6,478,614 | B1 * | 11/2002 | De'Longhi | 439/519 |
| 6,481,254 | B1 | 11/2002 | Zheng et al. | |
| 6,565,363 | B2 * | 5/2003 | Downing | 439/39 |
| 6,568,942 | B2 * | 5/2003 | Lau et al. | 439/39 |
| 6,607,391 | B2 | 8/2003 | Mendelson et al. | |
| 6,910,911 | B2 | 6/2005 | Mellott et al. | |
| 7,217,059 | B1 | 5/2007 | Rudduck | |
| 7,264,479 | B1 | 9/2007 | Lee | |
| 7,344,380 | B2 | 3/2008 | Neidlein et al. | |
| 7,351,066 | B2 | 4/2008 | DiFonzo et al. | |
| 7,399,205 | B2 * | 7/2008 | McNeely et al. | 439/577 |
| 7,445,452 | B1 * | 11/2008 | Wu | 439/39 |
| 7,497,693 | B1 * | 3/2009 | Wu | 439/39 |
| 7,498,546 | B2 | 3/2009 | Belongia et al. | |
| 7,566,224 | B2 | 7/2009 | Wu | |
| 7,575,389 | B2 | 8/2009 | Nance | |
| 7,607,920 | B1 | 10/2009 | Chen | |
| 7,625,213 | B1 * | 12/2009 | Tse | 439/39 |
| 7,637,746 | B2 | 12/2009 | Lindberg et al. | |
| 7,645,143 | B2 | 1/2010 | Rohrbach et al. | |
| 7,658,613 | B1 | 2/2010 | Griffin et al. | |
| 7,997,906 | B2 * | 8/2011 | Ligtenberg et al. | 439/38 |
| 2001/0031565 | A1 * | 10/2001 | Sakiyama | 439/38 |
| 2002/0086559 | A1 * | 7/2002 | Dalmau Ferrerfabrega et al. | 439/39 |
| 2003/0045134 | A1 * | 3/2003 | Downing | 439/38 |
| 2007/0072443 | A1 | 3/2007 | Rohrbach et al. | |
| 2007/0161262 | A1 | 7/2007 | Lloyd | |
| 2007/0243724 | A1 | 10/2007 | Tai et al. | |
| 2007/0254510 | A1 | 11/2007 | DeBey | |
| 2007/0259536 | A1 | 11/2007 | Long et al. | |
| 2008/0096398 | A1 | 4/2008 | Rohrbach et al. | |
| 2008/0139005 | A1 | 6/2008 | Guo et al. | |
| 2008/0280461 | A1 | 11/2008 | DiFonzo et al. | |
| 2008/0305649 | A1 | 12/2008 | Didur et al. | |
| 2009/0239392 | A1 | 9/2009 | Sumitomo et al. | |
| 2010/0035441 | A1 | 2/2010 | Rohrbach et al. | |
| 2010/0283269 | A1 * | 11/2010 | Fiedler | 292/251.5 |

FOREIGN PATENT DOCUMENTS

| | | | |
|---|---|---|---|
| GB | 2174556 | A | 11/1986 |
| WO | 02060292 | A1 | 8/2002 |

* cited by examiner

MAGNETIC CONNECTION FOR CABLE ASSEMBLY OF ELECTRONIC DEVICE

FIELD OF THE INVENTION

The present invention relates to cable connectors for connecting power and/or data cables to electronic devices.

BACKGROUND OF THE INVENTION

Traditionally, many hand-held electronic devices have a cable that brings power and/or signal wires to and from the device itself. In many cases, the cable is generally the most wearable part and often needs to be replaced. Strain relief designs have increased the durability of a cable assembly, but the cable assembly is most often the weak link and fails before the rest of the device. Replacing cables in the field can be costly for several reasons, including but not limited to: (1) time lost while the device is out of service, (2) cost of personnel to perform the rework action, (3) cost to ship the device back to the original equipment manufacturer ("OEM") to provide the rework service (if required), and (4) cost of replacement components as the device is disassembled and reassembled during repair service.

Where a reliable connection between the cable and device is important, it is known to provide a mechanical coupling to secure the connection against inadvertent or unintended disconnection. A familiar mechanical coupling arrangement comprises one or more screws carried at the connector end of the cable and mating into corresponding threaded holes in the device. Such a connection is time consuming to tighten during installation and to disconnect for repair or replacement. Moreover, disconnection may be carried out by anyone with a common screwdriver. This may be undesirable from a security and/or safety standpoint in some settings, for example in hospitals or other health care settings.

There are magnetic "breakaway" cable connectors wherein magnetic force holds the connection between the cable and the device. These have a tendency to become disconnected inadvertently if tugged, even with a relatively low tugging force. As a result, cable wear is avoided but unintended disconnection is a problem.

There is a need for an invention that provides a reliable connection between the cable and the device, wherein the connection is efficient to connect during set-up and efficient to disconnect when replacement or repair is required. There is also a need for a cable connection that is relatively secure against disconnection by unauthorized personnel.

SUMMARY OF THE INVENTION

The present invention provides a connection apparatus for receiving and retaining a cable connector that meets the needs mentioned above.

The connection apparatus of the present invention receives and retains a cable connector having an external recess. The connection apparatus comprises a housing defining a receptacle sized to receive the cable connector, a compartment, and a passage communicating between the compartment and the receptacle. The connection apparatus also comprises a spring member located in the compartment and a retaining element coupled to the spring member. The retaining element is magnetic and is configured to extend through the passage in the housing and into the external recess of the cable connector when the cable connector is received in the receptacle, such that the retaining element acts to retain the cable connector in the receptacle. The retaining element is removable from within the external recess of the cable connector against the bias of the spring member by a magnetic force applied from a location external to the housing. A tool having a magnet may be used to apply the magnetic force to remove the retaining element from the recess in the cable connector to permit withdrawal of the cable connector from the receptacle. The retaining element may include a sloped surface such that the retaining element is displaced against the bias of the spring member during insertion of the cable connector and the retaining element snaps into the recess under spring force when the cable connector is fully inserted. In an embodiment of the invention, the spring member is a flat spring member, and the magnetic retaining element is fixed to a surface of the spring member.

The present invention also encompasses a connection assembly comprising a connection apparatus as summarized above in combination with a cable including a cable connector at an end thereof, wherein the cable connector has an external recess arranged to receive the retaining element.

BRIEF DESCRIPTION OF THE DRAWING VIEWS

The invention will be described in detail below with reference to the accompanying drawing figures, in which.

DETAILED DESCRIPTION OF THE INVENTION

Figure 1:
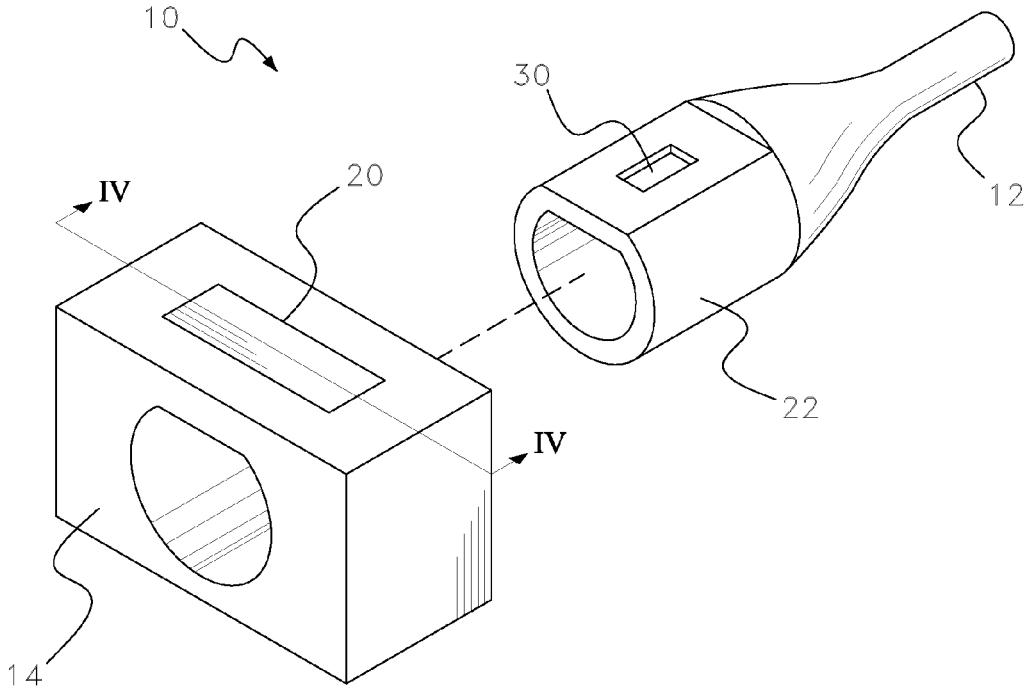
FIG. 1 is a perspective view showing a cable connector and connection apparatus formed in accordance with an embodiment of the present invention, prior to insertion of the cable connector into the connection apparatus.
Figure 2:
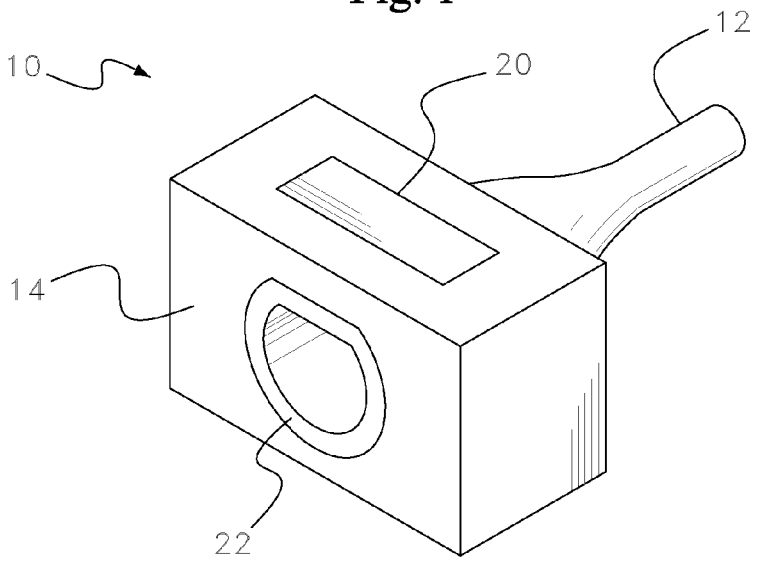
FIG. 2 is a perspective view similar to that of FIG. 1, however showing the cable connector and connection apparatus after insertion of the cable connector into the connection apparatus to form a connection assembly.
Figure 3:
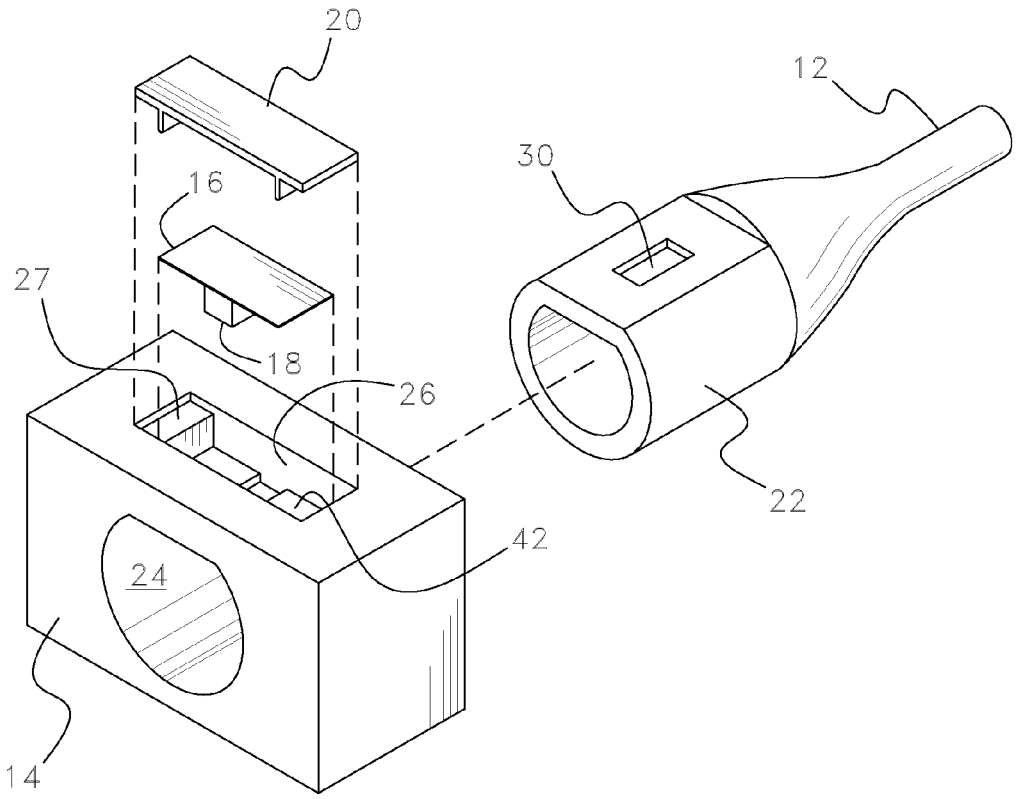
FIG. 3 is an exploded perspective view of the connection assembly shown in FIG. 2.

FIGS. 1-3 depict a connection assembly 10 formed in accordance with an embodiment of the present invention. Assembly 10 generally comprises a cable 12, a housing 14, a spring member 16, a magnetic retaining element 18, and a cover 20. Cable 12 includes a cable connector 22 at an end thereof, and housing 14 defines a receptacle 24 sized to receive cable connector 22. In the drawings, cable connector 22 is shown without internal wiring and electrical contacts for sake of simplicity. As may be understood, housing 14 may be integrally formed with, or attached to, an electronic device (not shown) having contact members arranged to mate with corresponding contact members associated with cable connector 22 to supply power and/or data signals to and/or from the electronic device via cable 12. As described further below, assembly 10 is designed to permit cable connector 22 to be received by receptacle 24 and mechanically held within the receptacle by retaining element 18, and to permit simple release of the retaining element 18 from its retaining position by application of a magnetic force applied from a location external to housing 14. In this manner, a reliable connection may be efficiently established and also quickly disconnected using a magnetic tool, without the need for tightening and untightening threaded fasteners.

Figure 4:
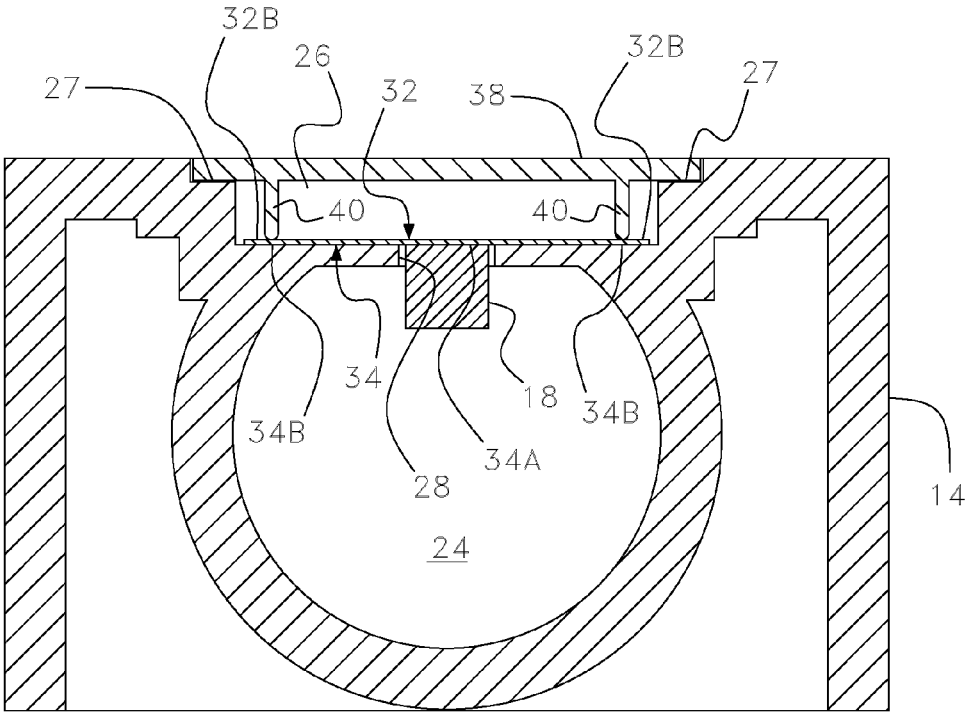
FIG. 4 is an enlarged transverse cross-sectional view taken generally along the line IV-IV in FIG. 1.
Figure 7A:
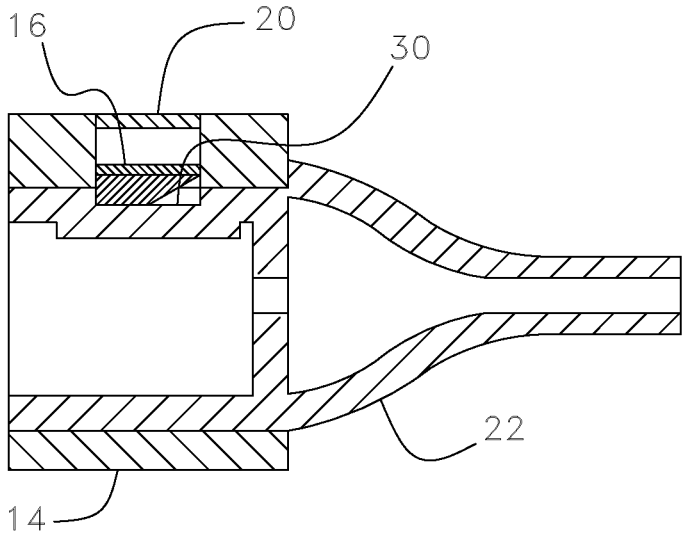
FIGS. 7A and 7B are longitudinal and transverse cross-sectional views, respectively, illustrating the cable connector and connection apparatus just after insertion of the cable connector into the connection apparatus.
Figure 7B:
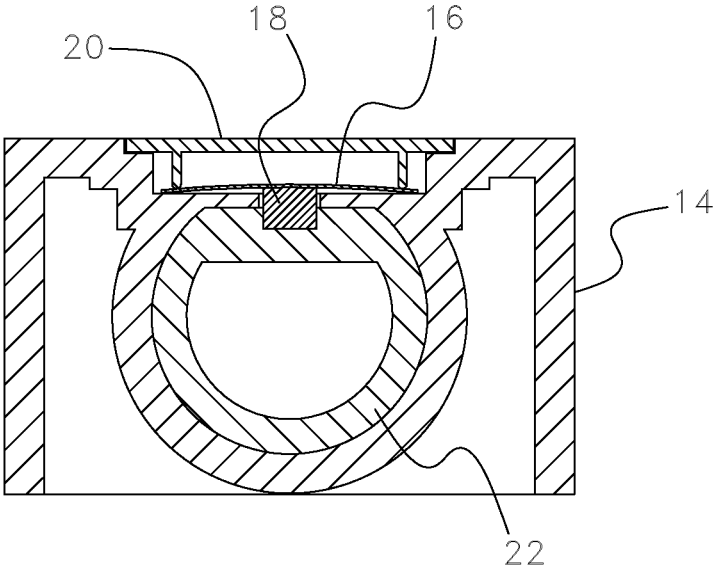

FIG. 4 shows an enlarged cross-sectional view of housing 14, spring member 16, magnetic retaining element 18, and cover 20 taken along the line IV-IV in FIG. 1. Housing 14 further defines a compartment 26 and a passage 28 communicating between compartment 26 and receptacle 24. Cable connector 22 has an external recess 30 (see FIG. 1) that registers with passage 28 when cable connector 22 is fully inserted into receptacle 24. Magnetic retaining element 18 is coupled to spring member 16 located in compartment 26 and is arranged to extend through passage 28 and into external recess 30 of cable connector 22 as shown in FIGS. 7A and 7B. The position of retaining element 18 depicted in FIGS. 7A and 7B is referred to as its retaining position because when retaining element 18 is in this position, it prevents cable connector 22 from being withdrawn out of housing receptacle 24.

In the drawing figures, spring member 16 is depicted as a flat spring member having a top surface 32 and a bottom surface 34 opposite the top surface, and magnetic retaining element 18 is fixed to the bottom surface 34 of spring member 16. As best understood from FIGS. 6A through 8, spring member 16 is resiliently deflectable to allow retaining element 18 to be displaced out of external recess 30 in cable connector 22 against the bias of the spring member. Those skilled in the art will realize that other types of spring members may be substituted for the flat spring member depicted in the figure. By way of non-limiting example, a coil spring, Belleville washer, wave washer, or other mechanical spring element may be used.

Cover 20 may be arranged to enclose compartment 26, for example by snap-fitted arrangement. Cover 20 may include one or more fulcrums 40 for engaging spring member 16 to hold spring member 16 in position within compartment 26 yet allow the spring member to deflect. In the illustrated embodiment, a pair of fulcrums 40 extend inwardly from a top portion 38 of cover 20 for engaging top surface 32 of spring member 16. Opposite ends of cover top portion 38 may be held at steps 27 at opposite sides of compartment 26. The magnetic retaining element 18 may be fixed to a mid-region 34A of the bottom surface 34 of spring member 16, and the bottom surface 34 may have a pair of bottom end regions 34B on opposite sides of magnetic retaining element 18. The bottom end regions 34B may be arranged to engage an internal surface 42 of compartment 26. Top surface 32 of spring member 16 may have a pair of top end regions 32B on opposite sides of the magnetic retaining element, and fulcrums 40 may be arranged for respectively engaging top end regions 32B.

Figure 5A:
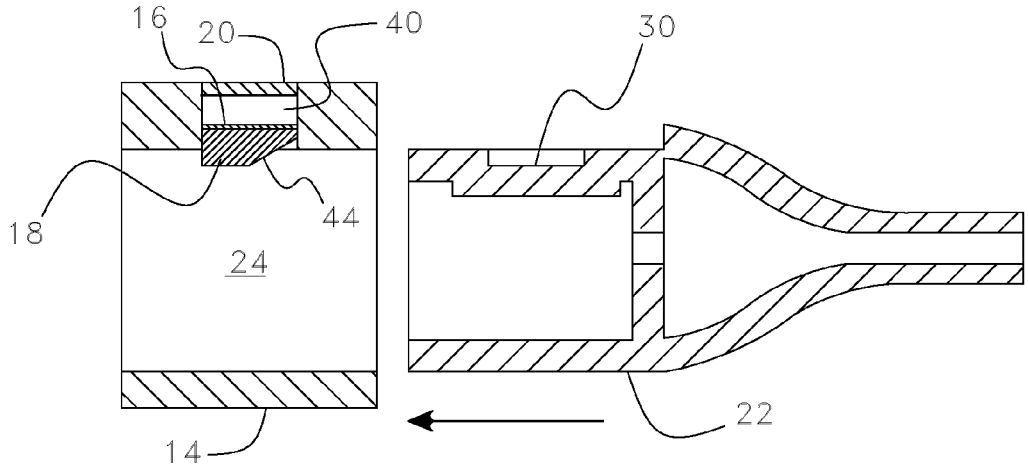
FIGS. 5A and 5B are longitudinal and transverse cross-sectional views, respectively, illustrating the cable connector and connection apparatus just prior to insertion of the cable connector into the connection apparatus.
Figure 5B:
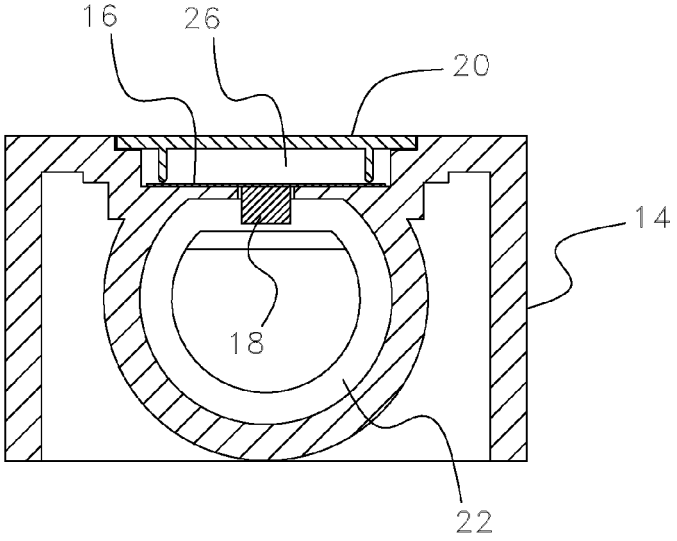

Magnetic retaining element 18 may include a sloped surface 44 (visible in FIGS. 5A, 6A, and 7A) arranged to be engaged by cable connector 22 as the cable connector is inserted into receptacle 24, whereby the retaining element is displaced against a bias of spring member 16 by mechanical camming action during insertion of the cable connector into the receptacle. Alternatively, a sloped surface (not shown) may be provided on cable connector 22 for the same purpose.

Figure 6A:
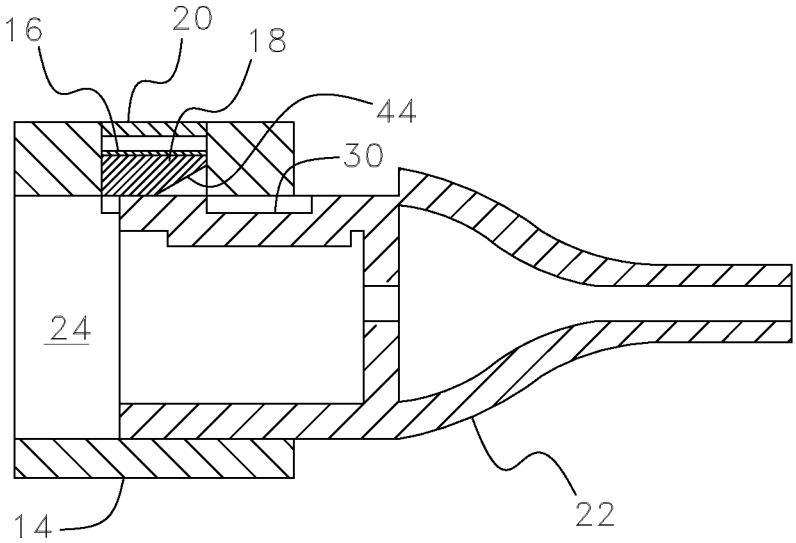
FIGS. 6A and 6B are longitudinal and transverse cross-sectional views, respectively, illustrating the cable connector and connection apparatus as the cable connector is being inserted into the connection apparatus.
Figure 6B:
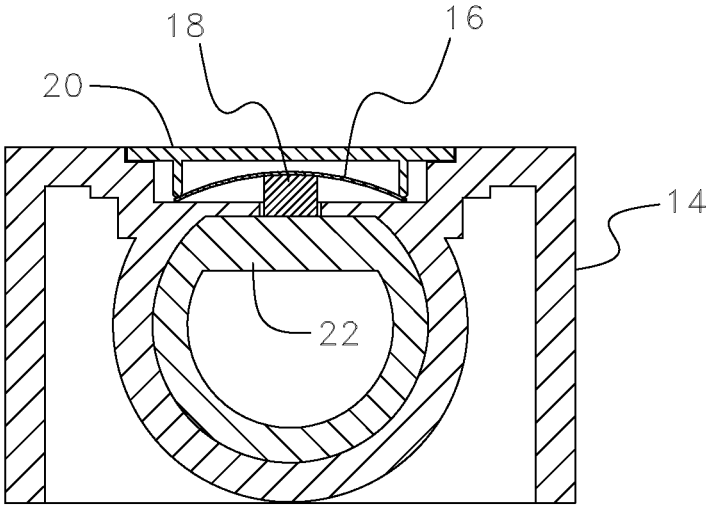

Operation of the invention will now be described with reference to FIGS. 5A through 8. As may be understood from FIGS. 5A and 5B, cable connector 22 is manually inserted in a longitudinal direction indicated by an arrow in FIG. 5A into receptacle 24 of housing 14. In the figures, magnetic retaining element 18 includes sloped surface 44. As cable connector 22 is inserted, it slidably engages sloped surface 44 as shown in FIG. 6A. As a result, retaining element 18 is pushed upward, causing spring member 16 to deflect as seen in FIG. 6B. Once cable connector 22 is inserted far enough so that external recess 30 on cable connector 22 registers with passage 28, the loaded spring member 16 urges retaining element 18 downward into recess 30, as depicted in FIGS. 7A and 7B. This is the aforementioned retaining position of magnetic retaining element 18. Retaining member 18 and recess 30 may be designed such that in this retaining position, spring member 16 experiences some deflection to provide loading in a direction transverse to the insertion direction for snug retention of cable connector 22.

Figure 8:
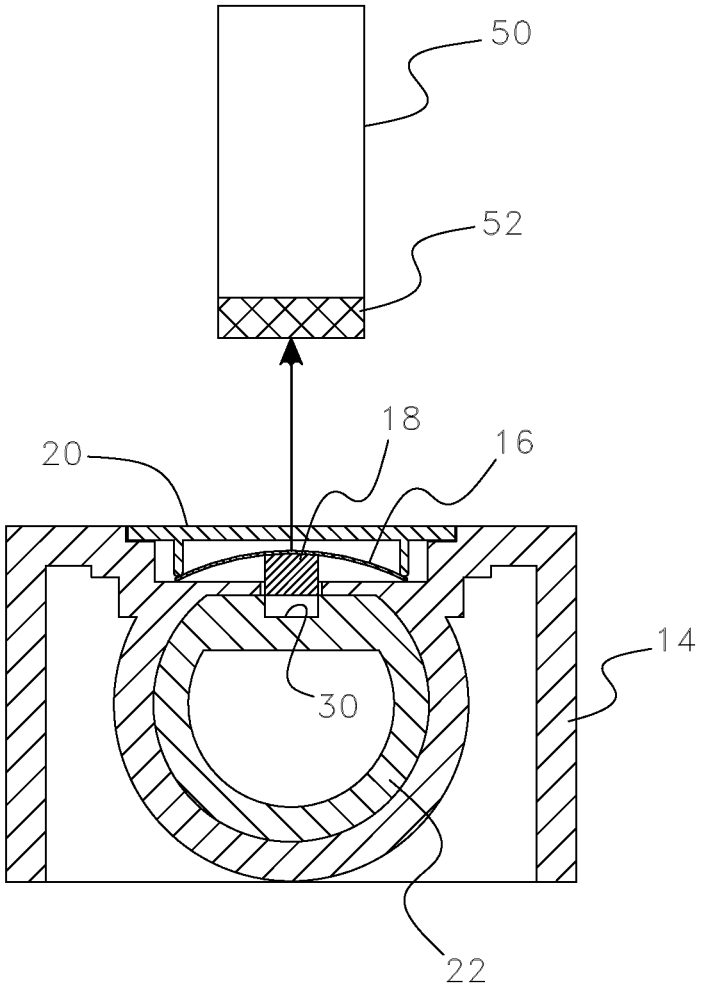
FIG. 8 is a transverse cross-sectional view illustrating the use of a magnetic tool to enable the cable connector to be withdrawn from the connection apparatus.

Magnetic force applied from a location external to housing 14 may be used to quickly and easily displace magnetic retaining element 18 out of recess 30 to permit manual removal of cable connector 22 from receptacle 24. FIG. 8 depicts a magnetic tool 50 comprising a rare earth magnet 52 that may be placed adjacent to an external surface of cover 20. A magnetic field associated with magnet 52 provides magnetic force urging retaining element 18 upward to temporarily remove retaining element 18 from recess 30, thus permitting disconnection and withdrawal of cable connector 22 from receptacle 24. Housing 14 may be generally hollow to minimize interference with the applied magnetic field. Magnetic tool 50 may incorporate structure other than a rare earth magnet, so long as the structure interacts with magnetic retaining element 18 by magnetic force.

As will be understood, application of magnetic force is required for disconnection, but may or may not be required for insertion of cable connector 22, depending upon whether retaining element 18 and/or cable connector 22 is configured to enable mechanical camming displacement of retaining element 18 during insertion of cable connector 22 as described above, for example by provision of sloped surface 44. If camming displacement of retaining element 18 is not enabled, then application of magnetic force may be used to displace retaining element 18 during insertion of cable connector 22 until recess 30 registers with retaining element 18, at which point magnetic force may be removed so that the bias of spring member 16 urges retaining element 18 into recess 30. Magnetic retaining element 18 may include a ferrous metal core (i.e. the retaining element may itself be a ferrous metal core or the retaining element may carry a ferrous metal core) for displacement in the presence of a magnetic field. As used herein, "magnetic" is intended broadly encompass elements and structures that are attracted or repelled by a magnetic field, and elements and structures that have or generate their own magnetic field. Modifications of tool 50 and retaining element 18 are of course possible, including without limitation the use of an electromagnet in place of rare earth magnet 52. While FIG. 8 illustrates use of magnetic attraction between magnetic retaining element 18 and tool magnet 52, the invention is not limited to the use of magnetic attraction, and the use of magnetic repellency to displace retaining element 18 is also within the scope of the invention.

Embodiments of the present invention are described in detail herein, however those skilled in the art will realize that modifications may be made. Such modifications do not stray from the spirit and scope of the invention as defined by the appended claims.

PARTS LIST

10 Connection assembly
12 Cable
14 Housing
16 Spring member
18 Magnetic retaining element
20 Cover
22 Cable connector
24 Receptacle in housing
26 Compartment in housing
27 Steps of housing compartment
28 Passage in housing
30 External recess in cable connector
32 Top surface of spring member
32B End region of top surface of spring member
34 Bottom surface of spring member
34A Mid-region of bottom surface of spring member
34B End region of bottom surface of spring member
38 Top portion of cover
40 Fulcrum of cover
42 Internal surface of compartment
44 Sloped surface of retaining element
50 Magnetic tool
52 Magnet of magnetic tool

What is claimed is:

1. A connection apparatus for receiving and retaining a cable connector having an external recess, the apparatus comprising:

a housing defining a receptacle sized to receive the cable connector, a compartment, and a passage communicating between the compartment and the receptacle;

a spring member located in the compartment;

a magnetic retaining element coupled to the spring member, the magnetic retaining element configured to extend through the passage in the housing and into the external recess of the cable connector when the cable connector is received in the receptacle; and wherein the retaining element is removable from within the external recess of the cable connector by a magnetic force applied from a location external to the housing.

2. The connection apparatus according to claim 1, wherein the spring member is a flat spring member having a top surface and a bottom surface opposite the top surface.

3. The connection apparatus according to claim 2, further comprising a cover enclosing the compartment, the cover including at least one fulcrum for engaging the spring member.

4. The connection apparatus according to claim 3, wherein the magnetic retaining element is fixed to the bottom surface of the spring member, and the at least one fulcrum is for engaging the top surface of the spring member.

5. The connection apparatus according to claim 3, wherein the magnetic retaining element is fixed to a mid-region of the bottom surface of the spring member, and the bottom surface of the spring member has a pair of bottom end regions on opposite sides of the magnetic retaining element.

6. The connection apparatus according to claim 5, wherein the pair of bottom end regions engage an internal surface of the compartment.

7. The connection apparatus according to claim 6, wherein the top surface of the spring member has a pair of top end regions on opposite sides of the magnetic retaining element, and wherein the at least one fulcrum includes a pair of fulcrums arranged for respectively engaging the pair of top end regions.

8. The connection apparatus according to claim 1, wherein the magnetic retaining element includes a sloped surface engaged by the cable connector as the cable connector is inserted into the receptacle, whereby the magnetic retaining element is displaced against a bias of the spring member during insertion of the cable connector into the receptacle.

9. The connection apparatus according to claim 1, wherein the magnetic retaining element includes a ferrous metal core.

10. The connection apparatus according to claim 1, further comprising a tool operable to apply the magnetic force from a location external to the housing to remove the retaining element from within the external recess of the cable connector.

11. A connection assembly comprising:

a cable including a cable connector at an end thereof, the cable connector having an external recess;

a housing defining a receptacle, a compartment, and a passage communicating between the compartment and the receptacle, wherein the cable connector is received by the receptacle;

a spring member located in the compartment;

a magnetic retaining element coupled to the spring member, the magnetic retaining element extending through the passage in the housing and into the external recess of the cable connector; and wherein the retaining element may be removed from within the external recess of the cable connector by a magnetic force applied from a location external to the housing.

12. The connection assembly according to claim 11, wherein the spring member is a flat spring member having a top surface and a bottom surface opposite the top surface.

13. The connection assembly according to claim 12, further comprising a cover enclosing the compartment, the cover including at least one fulcrum for engaging the spring member.

14. The connection assembly according to claim 13, wherein the magnetic retaining element is fixed to the bottom surface of the spring member, and the at least one fulcrum is for engaging the top surface of the spring member.

15. The connection assembly according to claim 14, wherein the magnetic retaining element is fixed to a mid-region of the bottom surface of the spring member, and the bottom surface of the spring member has a pair of bottom end regions on opposite sides of the magnetic retaining element.

16. The connection assembly according to claim 15, wherein the pair of bottom end regions engage an internal surface of the compartment.

17. The connection assembly according to claim 16, wherein the top surface of the spring member has a pair of top end regions on opposite sides of the magnetic retaining element, and wherein the at least one fulcrum includes a pair of fulcrums arranged for respectively engaging the pair of top end regions.

18. The connection assembly according to claim 11, wherein at least one of the magnetic retaining element and the cable connector includes a sloped surface for causing displacement of the magnetic retaining element against a bias of the spring member when the magnetic retaining element is engaged by the cable connector during insertion of the cable connector into the receptacle.

19. The connection assembly according to claim 11, wherein receipt of the magnetic retaining element in the external recess of the cable connector is accompanied by loading of the spring member.

20. The connection apparatus according to claim 11, wherein the magnetic retaining element includes a ferrous core.

* * * * *